US007616916B2

(12) United States Patent
Hozono et al.

(10) Patent No.: US 7,616,916 B2
(45) Date of Patent: Nov. 10, 2009

(54) IMAGE FORMING DEVICE

(75) Inventors: Tomohide Hozono, Osaka (JP); Hiroyoshi Omura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 466 days.

(21) Appl. No.: 11/711,651

(22) Filed: Feb. 28, 2007

(65) Prior Publication Data

US 2007/0212108 A1 Sep. 13, 2007

(30) Foreign Application Priority Data

Mar. 8, 2006 (JP) ..... 2006-062539

(51) Int. Cl.
*G03G 15/08* (2006.01)

(52) U.S. Cl. ..... 399/121; 399/302; 399/308

(58) Field of Classification Search ..... 399/107, 399/110, 113, 114, 121, 297, 302, 308
See application file for complete search history.

(56) References Cited

U.S. PATENT DOCUMENTS 7,058,345 B2 * 6/2006 Abe et al. ..... 399/303
7,257,351 B2 * 8/2007 Tachiki et al. ..... 399/121
7,313,345 B2 * 12/2007 Inaba et al. ..... 399/113
7,400,852 B2 * 7/2008 Furukawa ..... 399/302

FOREIGN PATENT DOCUMENTS

JP 2002-258632 A 9/2002

* cited by examiner

*Primary Examiner*—Hoan H Tran
(74) *Attorney, Agent, or Firm*—Global IP Counselors, LLP

(57) ABSTRACT

An image forming unit 100 has a main body 1 and an opening unit 22 that can be opened and closed with respect to the main body 1. An installation unit 99 is provided to install the secondary transfer roller 20 in the opening unit 22 so that a secondary transfer roller 20 of the opening unit 22 can move within a predetermined space within a bearing holder 25. When the opening unit 22 is closed, the secondary transfer roller 20 presses against an opposing roller 21 of the main body 1. A groove 32 in the main body 1 is formed in a direction different from a trajectory on which the shaft 20*a* of the secondary transfer roller 20 moves when closing the opening unit 22. The shaft 20*a* of the secondary transfer roller 20 is inserted into the groove 32 while moving within the predetermined space.

10 Claims, 12 Drawing Sheets

IMAGE FORMING DEVICE

CROSS-REFERENCE TO RELATED APPLICATIONS

This application claims priority to Japanese Patent Application No. 2006-062539 filed on Mar. 8, 2006. The entire disclosure of Japanese Patent Application No. 2006-062539 is hereby incorporated herein by reference.

BACKGROUND OF THE INVENTION

1. Field of the Invention

The present invention generally relates to image forming devices. More specifically, the present invention relates to image forming devices such as photocopiers, facsimile machines, and printers.

2. Background Information

In image forming devices such as photocopiers and printers, a sheet transport path is provided extending effectively vertically near a side surface of the device so that the device as a whole can be reduced in size. A pair of transfer rollers is disposed in this sheet transport path that extends practically vertically to transfer images onto sheets. In this image forming device, the pair of transfer rollers and a transport guide surface that guides the transport of sheets, and so on, are unitized. Also, an end of this unit is rotatably supported near the side surface of the device. If the unit is rotated about the support as center, the extent of the transport path is exposed, and dealing with jams or maintenance operations can easily be carried out (see Japanese Patent Application Laid-open No. 2002-258632).

The following is an explanation of the rotatable unit described in the above document. FIG. 13 is a front cross-sectional diagrammatical view showing the configuration of the movable unit portion of the image forming device according to the above document. A unit 102 that can move with respect to a main body 100 is disposed in the image forming device shown in FIG. 13. By rotating the unit 102, a position in which the transport path is exposed (open state) and a position in which the transport path is not exposed (closed state) can be obtained.

The unit 102 includes a transfer roller 103 indicated by the broken line, and a sheet transport guide formed on the inside.

Also, a photosensitive drum 104 indicated by a broken line is provided in the main body 100, and a groove 106 is formed by a bearing guide 105 provided near the photosensitive drum 104.

When the unit 102 is rotated about a support point 102*a*, a shaft 103*a* of the transfer roller 103 is inserted into the groove 106, and the transfer roller 103 is pressed against the photosensitive drum 104.

In the image forming device according to the above document, when the unit 102 is rotated into the closed position, the shaft 103*a* moves in the trajectory indicated by T in FIG. 13. Therefore the groove 106 must be formed along the direction of the trajectory T of the shaft 103*a*, and it is not possible to form the groove 106 in another direction.

Therefore, the degree of freedom is reduced in the design of the unit that can freely open and close and also reduced in the design of the main body.

In view of the above, it will be apparent to those skilled in the art from this disclosure that there exists a need for an improved image forming device. This invention addresses this need in the art as well as other needs, which will become apparent to those skilled in the art from this disclosure.

SUMMARY OF THE INVENTION

With the aforementioned problem of the conventional image forming devices in view, it is an object of the present invention to provide an image forming device for which it is possible to increase the degree of freedom of design compared with the conventional art.

An image forming device according to a first aspect of the present invention has an image forming unit, a main body, an opening unit, a first roller, an installation unit, and a second roller. The image forming unit is capable of forming images based on image information. The main body has a transport path to transport sheets to form images by the image forming unit. Further, the image forming unit is disposed within the main body. The opening unit can be positioned in an open position in which the transport path is exposed or in a closed position in which the transport path is not exposed, and is capable of opening and closing with respect to the main body. The first roller is installed on the opening unit. The installation unit is provided to install the first roller in the opening unit, and connects to a bearing guide disposed on the main body provided with a groove into which the shaft of the first roller can be inserted such that the shaft of the first roller can move within a predetermined space. The second roller is provided in the main body, against which the first roller presses when the opening unit is in the closed position. The groove is formed extending in a direction that is different from the direction of the trajectory on which the shaft of the first roller moves when closing the opening unit. When the opening unit is being closed the shaft of the first roller is inserted into the groove while moving within the predetermined space.

The image forming device according to a second aspect of the present invention is the image forming device according to the first aspect, wherein when the shaft of the first roller moves within the predetermined space, and the shaft of the first roller moves while contacting a frame surface of the main body that connects to the groove.

The image forming device according to a third aspect of the present invention is the image forming device according to the first aspect, wherein the installation unit has an elastic member that presses the first roller against the second roller, and the shaft of the first roller moves within the predetermined space while all or a part of the force taken when the opening unit is being closed is absorbed by the elastic member.

The image forming device according to a fourth aspect of the present invention is the image forming device according to the third aspect, wherein the installation unit has a bearing member into which the shaft of the first roller is installed and a bearing holder that holds the bearing member and that is fixed to the frame surface of the opening unit to cover the bearing member. Further, the elastic member is provided between the bearing member and the surface of the opening unit, and the predetermined space is provided between the bearing member and the elastic member.

The image forming device according to a fifth aspect of the present invention is the image forming device according to the first aspect, wherein the first roller is a secondary transfer roller, the second roller is an opposing roller in opposition to the secondary transfer roller. Further, an intermediate transfer belt is provided between the secondary transfer roller and the opposing roller and wound around the opposing roller, and the opposing roller is pressed by the secondary transfer roller via the intermediate transfer roller.

The image forming device according to a sixth aspect of the present invention is the image forming device according to the first aspect, wherein the first roller is a transfer roller, the second roller is a photosensitive drum, and the photosensitive drum is pressed by the transfer roller.

The image forming device according to a seventh aspect of the present invention is the image forming device according to the fourth aspect, wherein the groove is provided between and formed by a pair of wall surfaces disposed to encompass a trajectory of the shaft of the first roller in the groove when opening and closing the opening unit. Further, the bearing holder has a sloping surface formed in the end on the main body side. Moreover, when opening the opening unit from the closed state, the first roller is pushed from the groove by at least one of the walls forming the groove and the sloping surface formed in the end on the main body side of the bearing holder.

The image forming device according to an eighth aspect of the present invention is the image forming device according to the fourth aspect, wherein when closing the opening unit from the open state, the first roller is inserted into the groove by sliding contact between the frame of the main body and the bearing holder and the shaft of the first roller.

The image forming device according to ninth aspect of the present invention is the image forming device according to the seventh aspect, wherein when closing the opening unit from the open state, the first roller is inserted into the groove by sliding contact between the frame of the main body and the bearing holder and the shaft of the first roller.

The image forming device according to a tenth aspect of the present invention is the image forming device according to any of the fourth, eighth, or ninth aspects, wherein the bearing holder has a holding frame formed to cover the shaft of the first roller, and two joining portions disposed at both ends of the holding frame in the vertical direction.

According to the present invention, it is possible provide an image forming device for which it is possible to increase the degree of freedom of design compared with the conventional art.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The following is an explanation of a photocopier 100 or an image forming device according to a preferred embodiment of the present invention. For purposes of this specification, the front side of the photocopier is defined as one side of the photocopier 100 substantially orthogonal to the direction of the paper flow.

Figure 1:
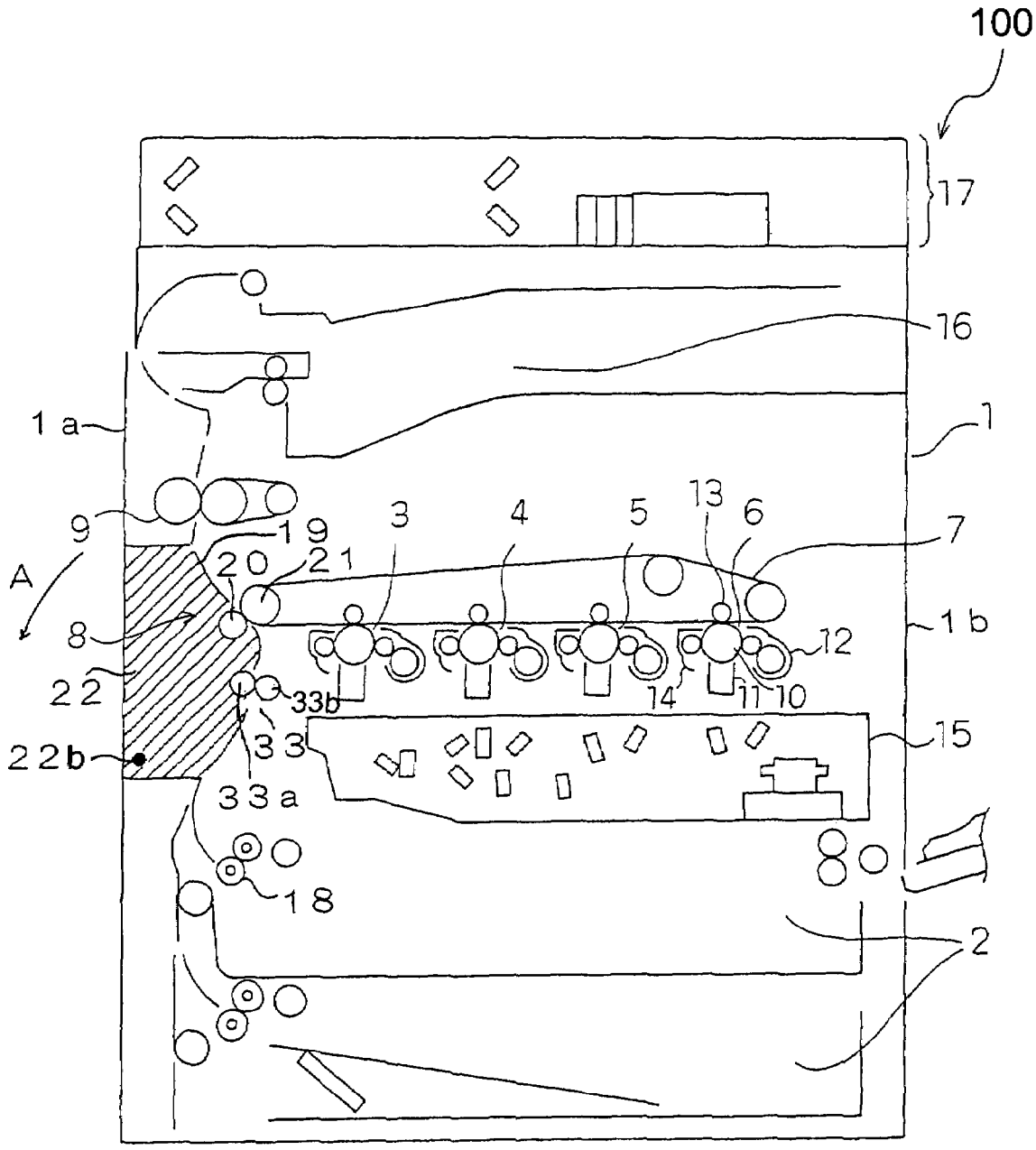
FIG. 1 is a front cross-sectional view of a photocopier according to a preferred embodiment of the present invention.

FIG. 1 is a front cross-sectional view of the photocopier 100. As shown in FIG. 1, the photocopier 100 includes two sheet supply cassettes 2 that store sheets on which images are formed in the bottom portion of the main body 1 of the photocopier 100. Also, the photocopier 100 according to the present embodiment includes a document reading unit 17 that reads image information for documents in the top portion of the main body 1. The document reading unit 17 includes a light exposure lamp, a lens, a mirror, and so on.

Also, the photocopier 100 according to the present embodiment is preferably a color photocopier using the tandem system. The main body 1 includes a black image forming unit 3 capable of forming black images based on image information, a yellow image forming unit 4 capable of forming yellow images based on image information, a cyan image forming unit 5 capable of forming cyan images based on image information, and a magenta image forming unit 6 capable of forming magenta images based on image information. An intermediate transfer belt 7 is disposed above the image forming units 3, 4, 5, and 6 to superimpose each of the images formed in the image forming units 3, 4, 5, and 6 before transfer to a sheet. The basic configuration of the four image forming units 3, 4, 5, and 6 is the same or substantially the same. Thus, only the magenta image forming unit 6 will be explained as an example. As shown in FIG. 1, the magenta image forming unit 6 includes a photosensitive drum 10 that is capable of carrying electrostatic latent images, a charging device 11 that charges the surface of the photosensitive drum 10, a developing device 12 that can supply developer to the photosensitive drum 10, a primary transfer roller 13 disposed in opposition to the photosensitive drum 10, and a cleaning unit 14 that cleans the surface of the photosensitive drum 10.

Further, a laser scanning unit (hereafter referred to as the LSU) 15 is disposed below the four image forming units 3, 4, 5, and 6. The LSU 15 forms electrostatic latent images by scanning with light the surface of each photosensitive drum 10 that has been charged by each charging device 11.

A pair of transfer rollers 8 that transfers toner images formed on the intermediate transfer belt 7 onto sheets supplied from the sheet supply cassettes 2 is provided at the end of the image forming units 3, 4, 5, and 6, i.e., on an end of the transfer unit 7. Furthermore, a fixing unit 9 that fixes the toner images transferred onto the sheets is provided above the pair of transfer rollers 8. Also, an output tray 16 is provided to which the sheets on which the toner images have been fixed by the fixing unit 9 are output.

Next, a sheet transport path 19 is explained.

Sheets stored in the sheet supply cassettes 2 are supplied by a pair of sheet supply rollers 18 disposed above the sheet supply cassettes 2. The sheets are transported to the output tray 16 via a pair of registration rollers 33, the pair of transfer rollers 8, and the fixing unit 9. Here, the pair of sheet supply rollers 18, the pair of transfer rollers 8, and the fixing unit 9 are disposed near the side wall 1*a* of the main body 1. The transport path 19 on which sheets are transported is formed along the side wall 1*a*.

Next, the pair of transfer rollers 8 is explained.

The pair of transfer rollers 8 includes a secondary transfer roller 20 that is disposed near the side wall 1*a*, and an opposing roller 21 disposed in a position in opposition to the secondary transfer roller 20 via the intermediate transfer belt 7. The transport path 19 passes between the pair of transfer rollers 8. The secondary transfer roller 20 presses against the opposing roller 21 so that toner images formed on the intermediate transfer belt 7 are transferred to the sheets.

Next, an opening unit 22 that can be freely opened and closed with respect to the main body 1 is explained.

Figure 2:
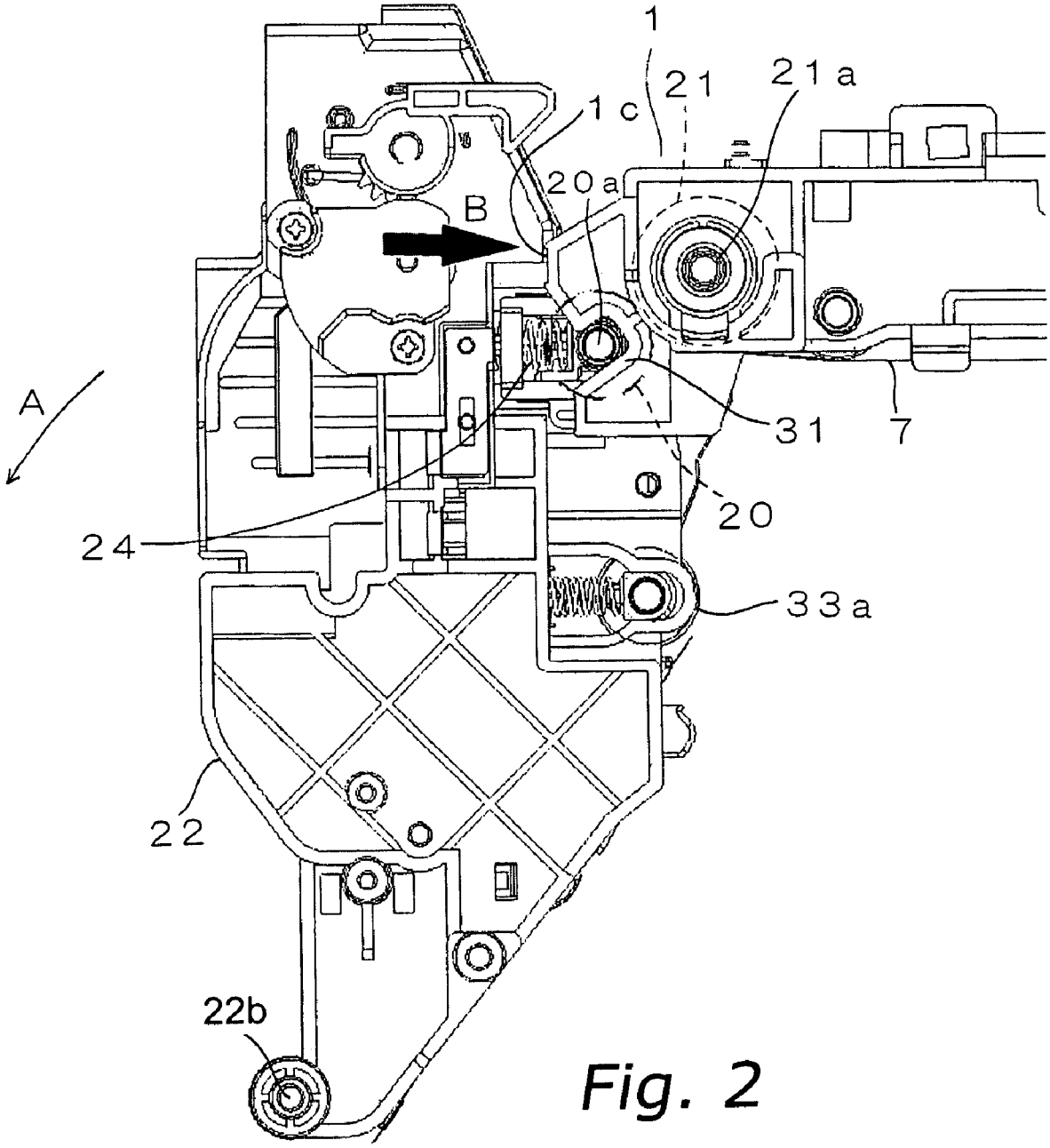
FIG. 2 is an enlarged view of a main body part and opening unit of the photocopier according to the embodiment of the present invention.

As seen in FIG. 1, the opening unit 22 is formed as a part near the side wall 1*a* based on the position of the transport path 19. The opening unit 22 is disposed in the location indicated by the hatching lines in FIG. 1. The secondary transfer roller 20 is installed in the opening unit 22, and the opening unit 22 rotates outwards about a support point 22*b* (see the arrow symbol A in FIG. 1). By rotating the opening unit 22, the opening unit 22 has a position in which the transport path 19 is exposed (open state) and a position in which the transport path 19 is not exposed (closed state). FIG. 2 is a front view showing the configuration of the opening unit 22 and a part of the main body 1. As shown in FIG. 2, a bearing guide 31 formed facing towards the center of the secondary transfer roller 20 is provided on the main body 1 side. The shaft 20*a* of the secondary transfer roller 20 is inserted into the bearing guide 31. Also, the secondary transfer roller 20 is pressed against the opposing roller 21 by a spring member 24 provided in the opening unit 22 that presses in the direction of the arrow symbol B. Also, a frame surface 1*c* in which the bearing guide 31 is formed forms a part of the transport guide of the transport path 19.

Figure 3:
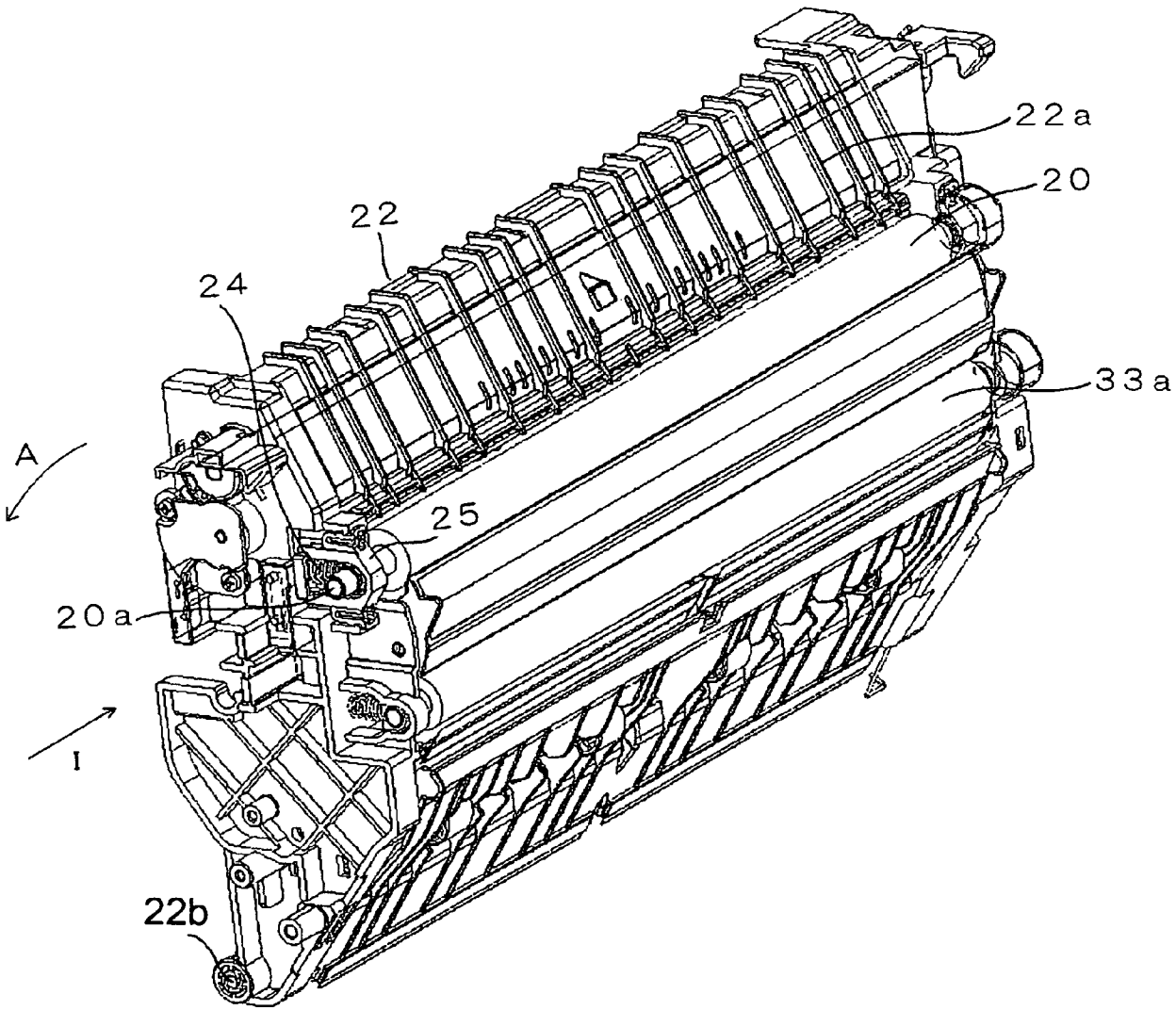
FIG. 3 is an isometric view of the opening unit according to the embodiment of the present invention.

FIG. 3 is an isometric view of the opening unit 22 as seen from the side opposite the side wall 1*a* side. As shown in FIG. 3, the secondary transfer roller 20 is installed on an inside surface 22*a* of the opening unit 22 at both ends of a shaft 20*a*. Further, FIG. 3 shows that one registration roller 33*a* of the pair of registration rollers 33 that was explained in connection with FIG. 1 is installed in the opening unit 22. The surface 22*a* of the opening unit 22 forms a part of the transport guide of the transport path 19.

Next, the installation structure of the secondary transfer roller 20 is explained.

Figure 4:
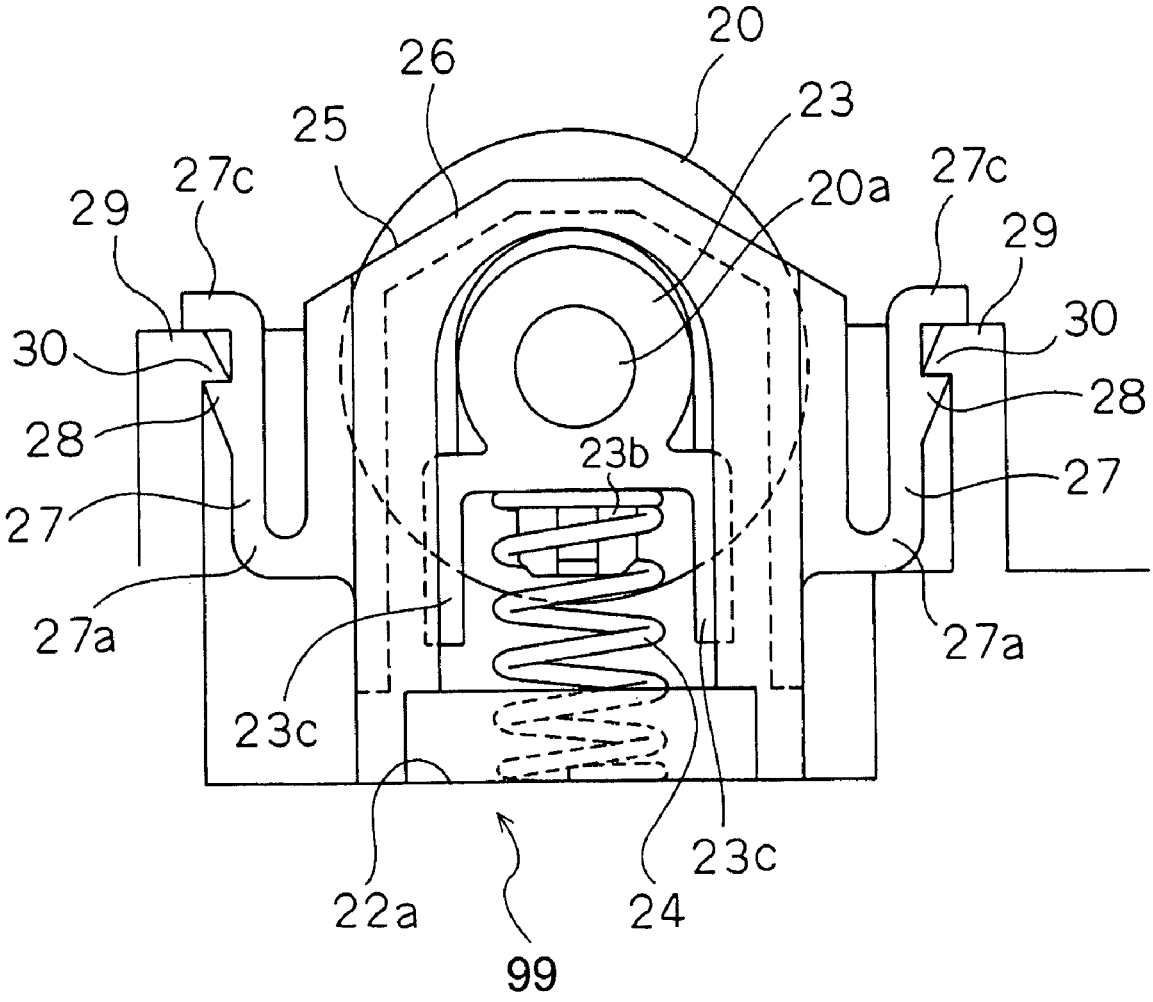
FIG. 4 is a front view of an opening unit part in which the transfer roller is installed in the opening unit according to the embodiment of the present invention.

FIG. 4 is a front view (a front view in the direction of the arrow I in FIG. 3) of one of the parts at which the secondary transfer roller 20 is installed in the opening unit 22. The secondary transfer roller 20 is installed in the opening unit 22 using a bearing member 23, a spring member 24, and a bearing holder 25, as shown in FIG. 4. The following is an explanation of the structure of these components in turn. An installation unit 99 includes the bearing member 23, the spring member 24, and the bearing holder 25.

Figure 5:
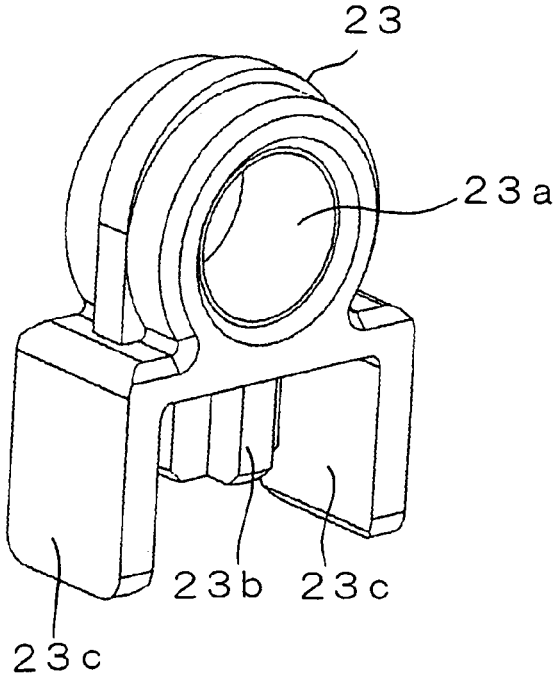
FIG. 5 is an isometric view of a bearing member of the opening unit part according to the embodiment of the present invention.

FIG. 5 is an isometric view of the bearing member 23. As shown in FIG. 4, the bearing member 23 is installed on the shaft 20*a* of the secondary transfer roller 20. Also, as shown in FIG. 5, the bearing member 23 includes a donut shaped bearing portion or aperture 23*a* into which the shaft 20*a* is inserted, a protruding portion 23*b* that extends outwards from the outer periphery of the bearing portion 23*a*, and wall members 23*c* formed to the left and right in FIG. 4 of and at a predetermined interval from and on opposite sides of the protruding portion 23*b*. The wall members 23*c* preferably extend in the same direction as the protruding portion 23*b*.

As shown in FIG. 4, one end of the spring member 24 is fixed to the surface 22*a* of the opening unit 22, and the other end is fitted to the protruding portion 23*b*. The two wall members 23*c* have the role of preventing the spring member 24 from separating from the protruding portion 23*b* in the left and right directions.

Figure 6:
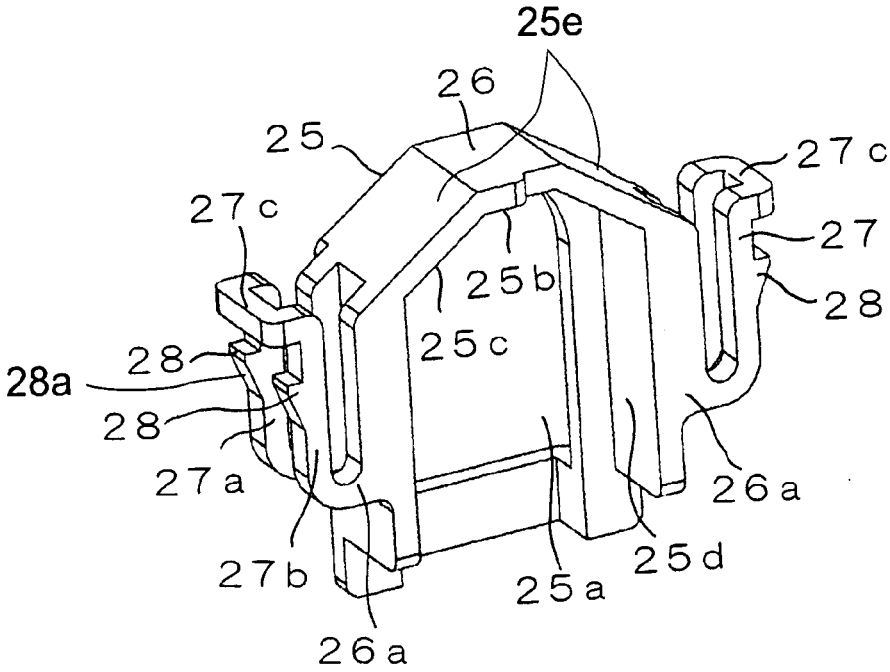
FIG. 6 is an isometric view of a bearing holder of the opening unit part according to the embodiment of the present invention.

FIG. 6 is an isometric view of the bearing holder 25. The isometric view of the bearing holder 25 shown in FIG. 6 is seen from the opposite side of the plane of the paper in FIG. 4. As shown in FIGS. 3 and 4, the bearing holder 25 covers the bearing member 23 from the top, and is fixed to the surface 22*a* of the opening unit 22.

As shown in FIG. 6, the bearing holder 25 includes a retaining frame 26 that covers the bearing member 23, and two joining portions 27 formed extending from below to above at a predetermined interval from the two ends of the retaining frame 26, or in a direction away from the surface 22*a* when attached. Also, sloping surfaces 25*e* are formed on the end of the bearing holder 25. The joining portions 27 and the holding frame 26 are connected at the bottom, i.e., the side that is to be closest to the surface 22*a* when attached, on both sides by connecting portions 26*a*. The inside surface of the holding frame 26 forms a hexagonal shape, preferably an irregular hexagonal shape, viewed from the front. Further, the space formed by this inside surface is an inside space 25*a*.

Also, each joining portion 27 includes two parallel members 27*a* and 27*b* that are connected by a tip 27*c* on the top, i.e., the portion of the joining portion arranged to be furthest away from the surface 22*a* when joined. The two members 27*a* and 27*b* are disposed with a predetermined spacing between them in the direction of the shaft 20*a*. Further, mating protrusions 28 that project outwards are formed on the members 27*a* and 27*b* that form the joining portions 27. The bottom side of the mating protrusions 28 have a tapered shape 28*a* that taper inward relative to the members 27*a* and 27*b*.

Figure 7:
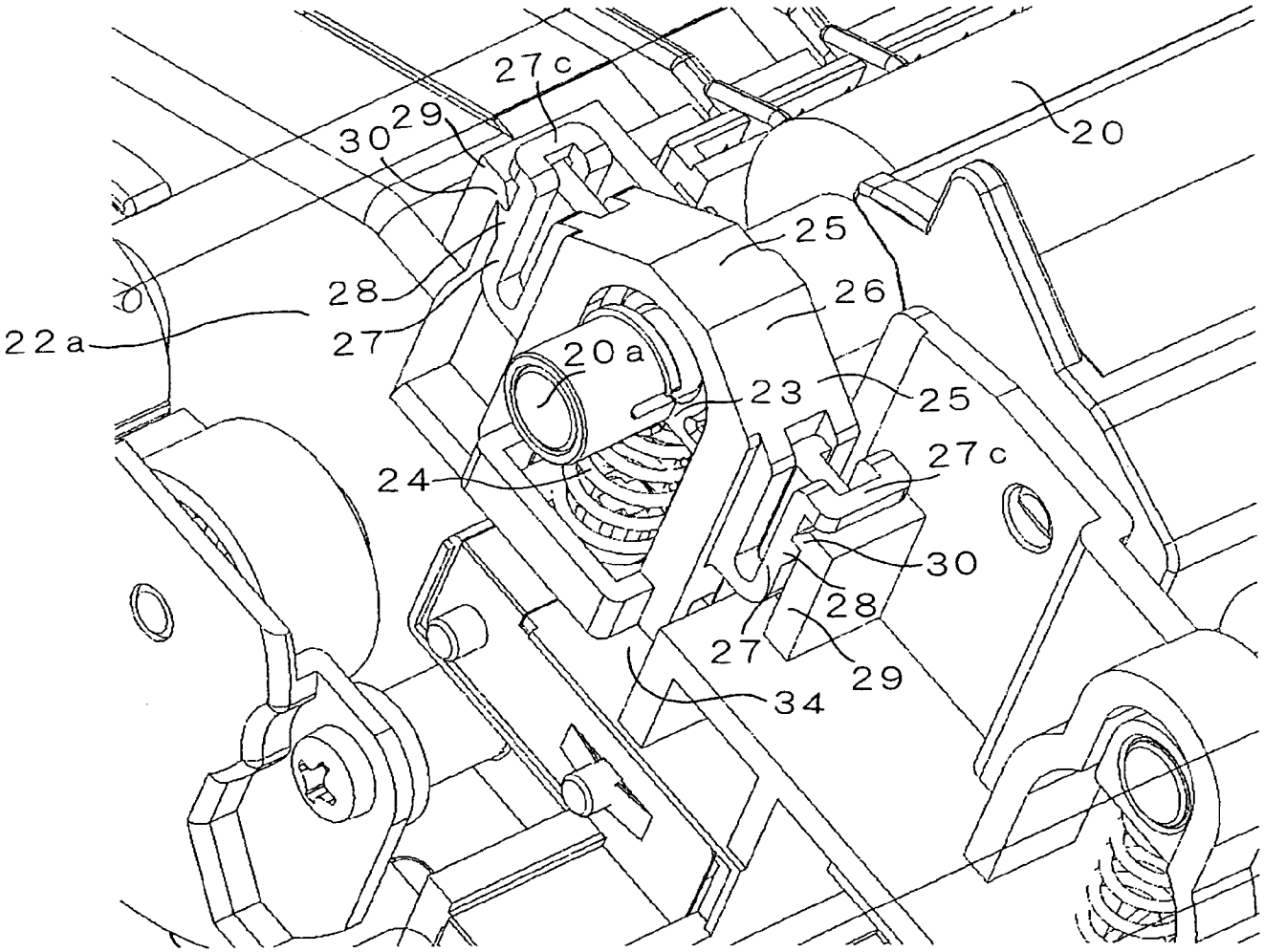
FIG. 7 is an isometric view of the part in which the transfer roller is installed in the opening unit according to the embodiment of the present invention.

FIG. 7 is an enlarged view of a location where the secondary transfer roller 20 is installed in the opening unit 22. Also, FIG. 8 is a front view of the bearing holder 25 and the part of the opening unit 22 where the bearing holder 25 is installed.

Figure 8:
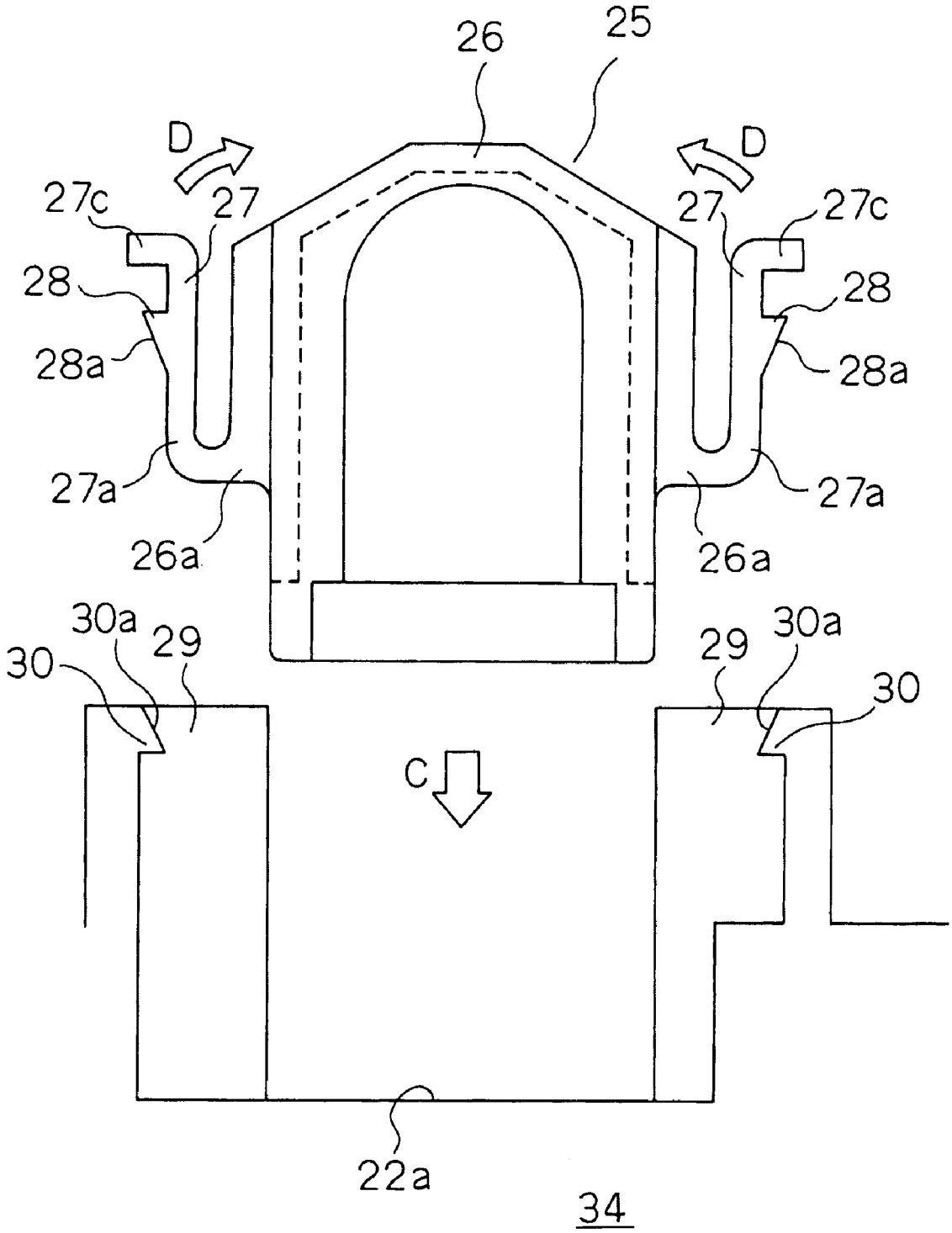
FIG. 8 is a front view of the bearing holder and opening unit part provided to explain a method of installing the bearing holder in the opening unit according to the embodiment of the present invention.

As shown in FIG. 7 and FIG. 8, an insertion portion 34 is formed in the surface 22*a* of the opening unit 22 to install the bearing holder 25. At both ends of the insertion portion 34, joining portions 29 are formed that mate with the joining portions 27 of the bearing holder 25. The joining portions 29 include mating protrusions 30 formed to fit between the mating protrusions 28 and the tips 27*c*. The top portions 30*a* of the mating protrusions 30 have a tapered shape.

As shown in FIG. 8, when the bearing holder 25 is installed in the insertion portion 34, by inserting the bearing holder 25 in the direction of the arrow C the tapered shapes 28*a* and the tapered shapes 30*a* come into frictional contact. Then, by further inserting the bearing holder 25 in the direction of the arrow C, the joining portions 27 rotate elastically about the connecting portions 26*a* in the direction of the holding frame 26 (see the arrow symbol D). Then as shown in FIG. 4 and FIG. 7, the mating portions 30 fit between the mating protrusions 28 and the tips 27*c* so that the bearing holder 25 is fixed to the insertion portion 34. Also, the joining portions 29 are formed to be able to fit between the two members 27*a* and 27*b* of the joining portions 27.

Next, the open state of the opening unit 22 is explained.

Figure 9:
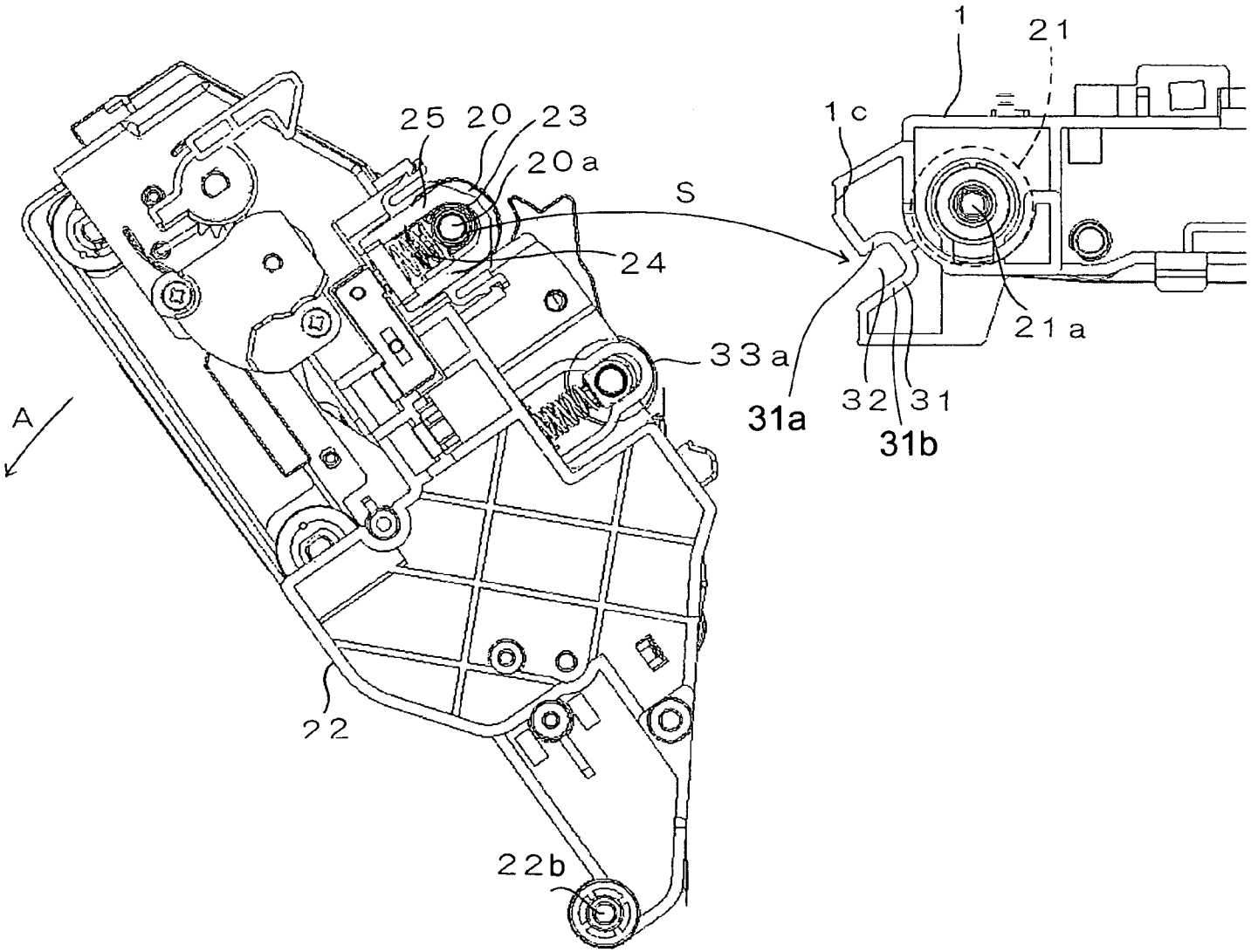
FIG. 9 is an enlarged view of the main body part and opening unit showing the opening unit in the open state in the image forming device according to the embodiment of the present invention.
Figure 10:
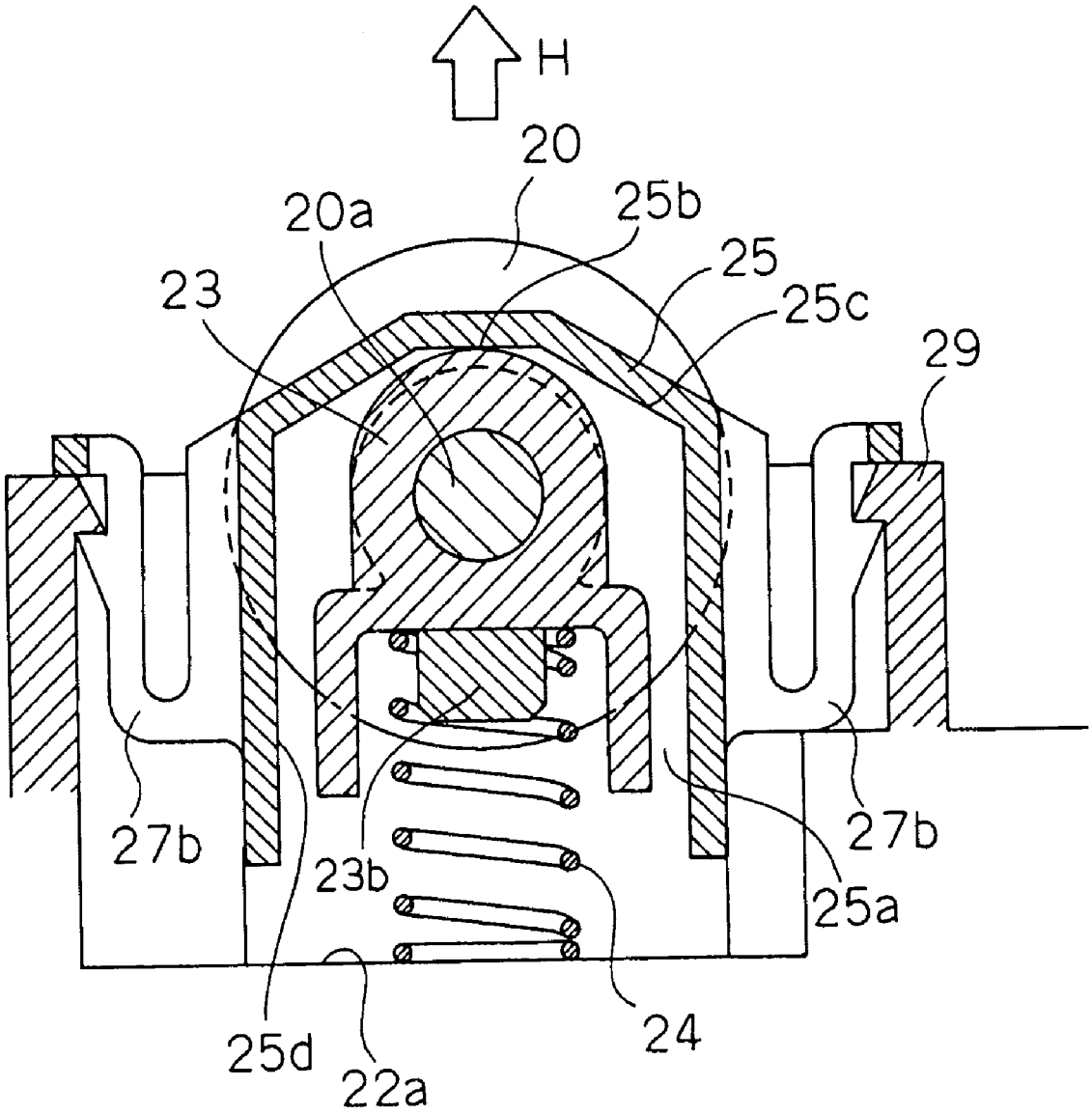
FIG. 10 is a cross-sectional diagrammatical view showing the positional relationship of the bearing member and the bearing holder when the opening unit of the image forming device is in the open state according to the embodiment of the present invention.

FIG. 9 is an enlarged view showing the main parts of the opening unit 22 in the state of being open or separated from the main body 1. Also, FIG. 10 is a front cross-sectional view of the part where the secondary transfer roller 20 is installed in the state shown in FIG. 9 (the opening unit 22 in the open state). FIG. 10 shows a section between the members 27*a* and 27*b* of the bearing holder 25.

As shown in FIG. 10, when the opening unit 22 is in the open state, the secondary transfer roller 20 has nothing to press against (in the closed state it presses against is the opposing roller 21). Therefore the bearing member 23 contacts the bearing holder 25 as a result of the force of the spring member 24 (see the arrow symbol H). In FIG. 10, the top surface (the surface opposite the surface 22*a*) that forms the inside space 25*a* is 25*b*, and the adjacent surface to the right is the inner surface 25*c*.

Here, as shown in FIG. 10, the inside space 25*a* of the bearing holder 25 is formed higher than the bearing member 23 so the bearing member 23 can move within the inside space 25*a*.

The first roller in the present invention corresponds, for example, to the secondary transfer roller 20 in the present embodiment, and the second roller in the present invention corresponds, for example, to the opposing roller 21 in the present embodiment. Also, the installation unit of the present invention corresponds, for example, to the bearing member 23, the spring member 24, and the bearing holder 25 in the present embodiment. Also, the predetermined space in the present invention corresponds, for example, to the inside space 25*a* of the present embodiment. Further, the elastic member of the present invention corresponds, for example, to the spring member 24 in the present embodiment.

Next, the opening and closing operation of the opening unit 22 is explained.

First, the closing operation of the opening unit 22 is explained.

From the state shown in FIG. 9, by rotating the opening unit 22 about the support point 22*b* as the center of rotation, the state becomes that shown in FIG. 2, and the opening unit 22 is in the closed state. Referring again to FIG. 9, during this closing operation, the shaft 20*a* of the secondary transfer roller 20 moves describing the trajectory S. Also, when the shaft 20*a* of the secondary transfer roller 20 rotates to describe the trajectory S in this way, the shaft 20*a* contacts the top portion of the bearing guide 31 of the frame surface 1*c*.

Figure 11A:
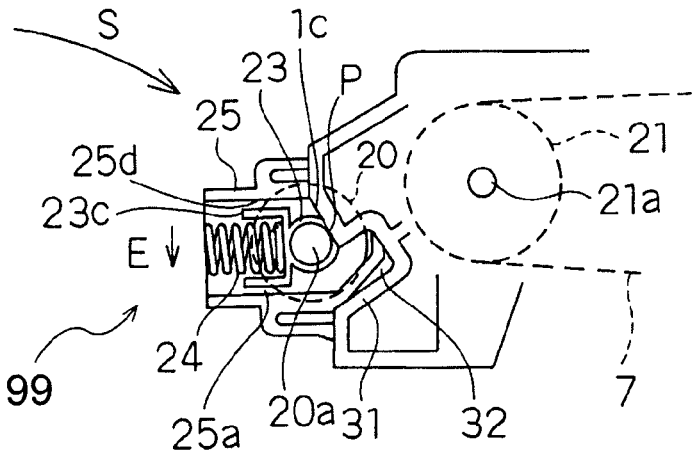
FIG. 11A through FIG. 11C are diagrammatical views showing the movement of a shaft of a secondary transfer roller of the opening unit when closing the opening unit in the image forming device according to the embodiment of the present invention.

FIG. 11A shows the shaft 20*a* of the secondary transfer roller 20 in contact with the top portion of the bearing guide 31 of the frame surface 1*c*. As shown in FIG. 11A, the shaft 20*a* contacts the part P of the frame above a groove 32 of the bearing guide 31 with the elastic force of the spring member 24. For the purposes of explanation, each configuration and operation are shown exaggerated in FIG. 11 and in FIG. 12 referred to below, as appropriate. Regardless, it is preferable that the groove 32 extend from a position below the center shaft 21*a* toward the center shaft 21*a* in a direction that does not describe the trajectory S.

Figure 11B:
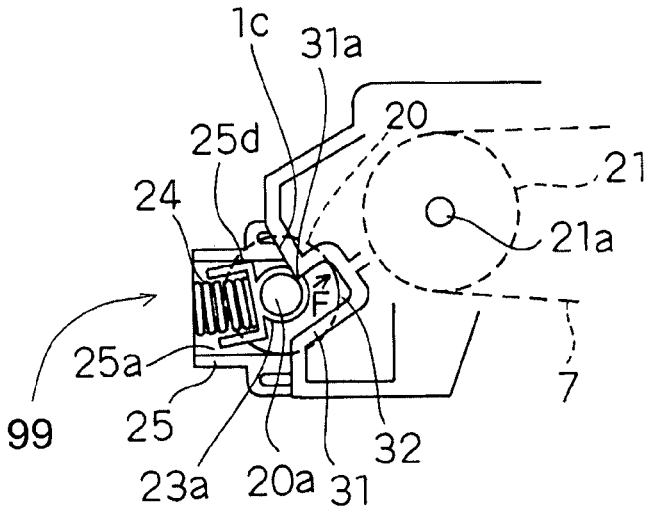

If the opening unit 22 is further rotated from this state, the bearing holder 25 rotates together with the opening unit 22. However, movement of the shaft 20*a* is limited by the frame surface 1*c* on the main body 1 side so the shaft 20*a* does not move. Therefore, as shown in FIG. 11B, an inside surface 25*d* (positioned to the top in FIG. 11, positioned to the left in FIG. 10) of the bearing holder 25 contacts the wall member 23*c* on the upper side of the bearing member 23, and the shaft 20*a* is pressed downwards in the direction of the arrow E together with the bearing member 23. When pressed down, the shaft 20*a* contacts the frame surface 1*c* on the body 1 side with the elastic force of the spring member 24. In other words, when the opening unit 22 is being closed, all or a part of the reaction force received by the shaft 20*a* from the frame surface 1*c* is absorbed by the spring member 24, and the shaft 20*a* moves within the inside space 25*a*. FIG. 11B shows the state where the shaft 20*a* has been pressed down, and is positioned at the top corner 31*a* of the groove 32. As shown in FIG. 11B, the movement of the shaft 20*a* is limited by the frame surface 1*c* on the main body 1 side, so the spring member 24 is shortened compared with FIG. 11A, and the shaft 20*a* is disposed in the top portion of the inside space 25*a* of the bearing holder 25.

Then, the shaft 20*a* is moved in the direction of the arrow F by the elastic force of the spring member 24, and is inserted into the groove 32. This state is shown in FIG. 11C.

Figure 11C:
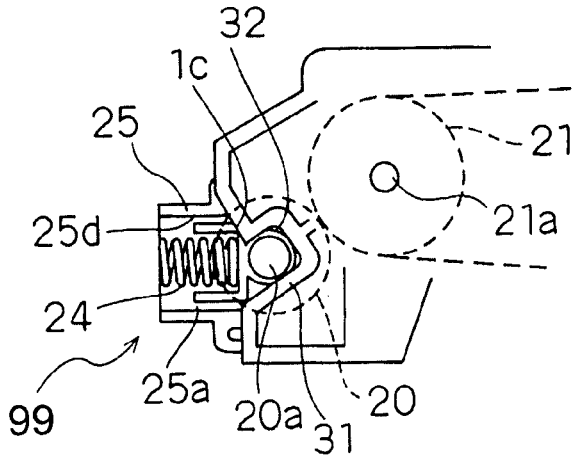

As shown in FIG. 11C, the movement of the shaft 20*a* in the direction of the arrow F stops at a position in which the surface of the secondary transfer roller 20 contacts the opposing roller 21 via the intermediate transfer belt 7.

Next, the opening operation of the opening unit 22 is explained.

Figure 12A:
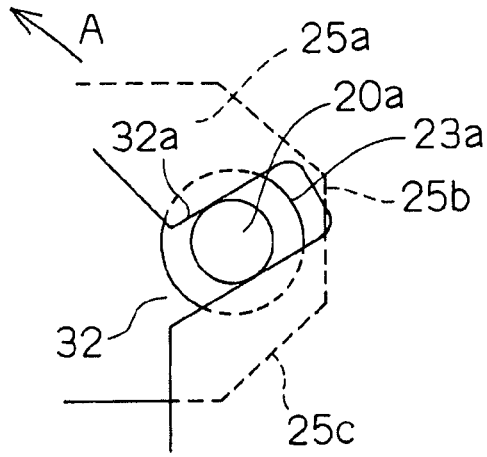
FIG. 12A through FIG. 12C is a diagrammatical views showing the movement of the shaft of the secondary transfer roller when opening the opening unit in the image forming device according to the embodiment of the present invention.

FIG. 12A is a simplified diagram showing the state in which the shaft 20*a* is inserted into the groove 32 (the closed state of the opening unit 22). In FIG. 12A only the bearing portion 23*a* of the bearing member 23 is shown. Also, only a part of the inner surface of the bearing holder 25 is shown. Also, the state in FIG. 12A corresponds to the state shown in FIG. 11C.

When the opening unit 22 is opened in the direction of the arrow A (see FIG. 2), the shaft 20*a* is restricted by the top surface 32*a* of the groove 32 so the shaft 20*a* does not rotate. However, the bearing holder 25 rotates in the direction of the arrow A together with the opening unit 22.

Figure 12B:
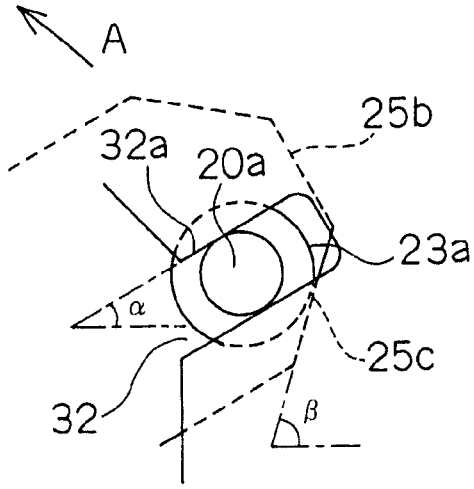
Figure 12C:
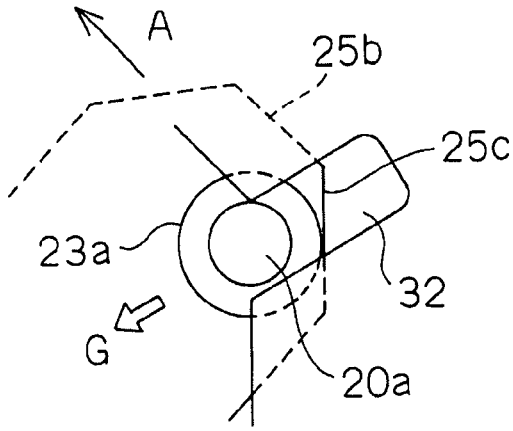
Figure 13:
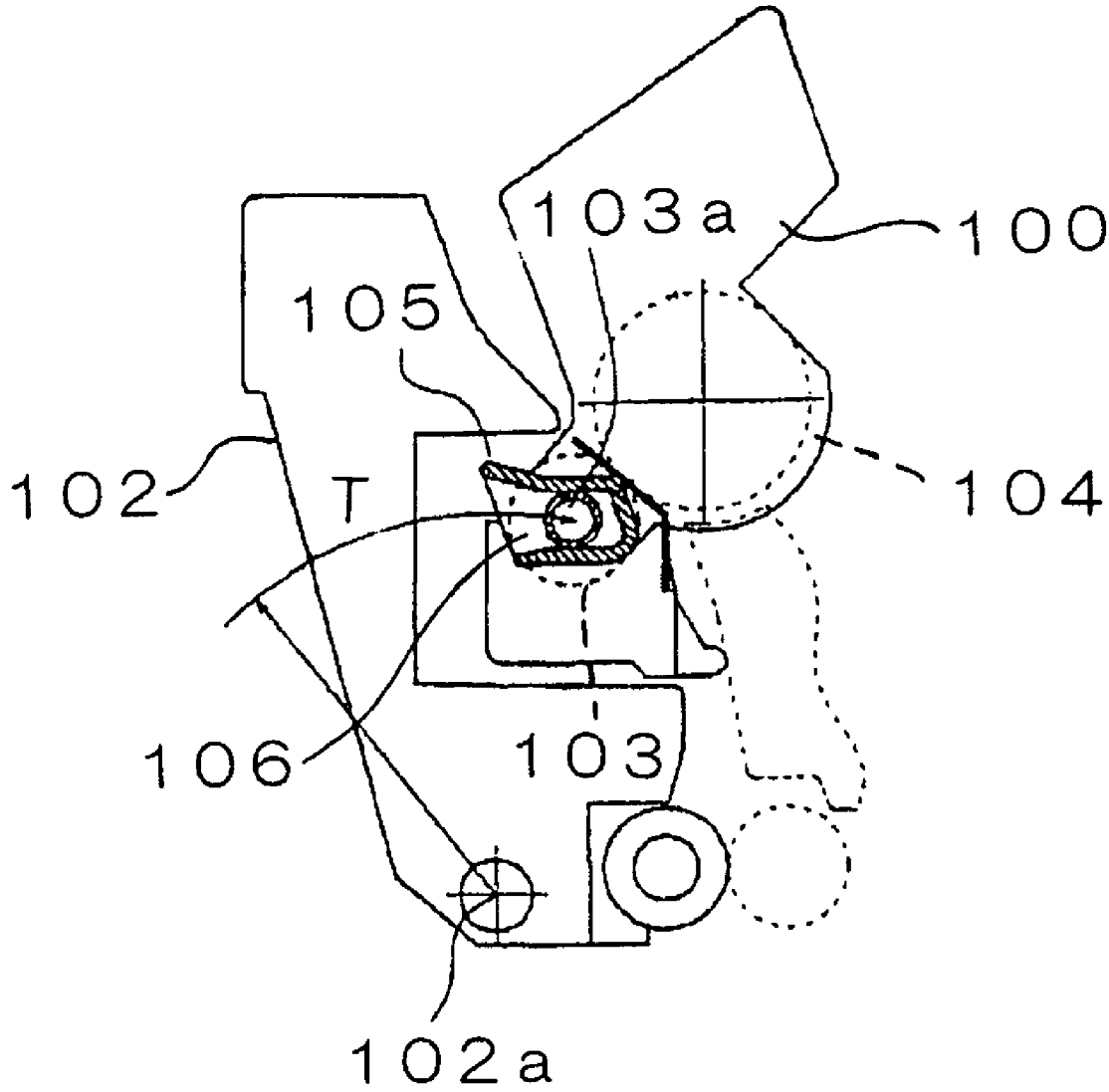
(PRIOR ART) Fig. 13
FIG. 13 is a diagrammatical view showing an opening unit in a conventional image forming unit.

FIG. 12B shows the state in which the bearing holder 25 is rotated, and the inner surface 25*c* is in contact with the bearing portion 23*a*. If the opening unit 22 is further rotated from this state, in FIG. 12B the angle $\alpha$ that the top surface 32*a* of the groove 32 is formed is smaller than the angle $\beta$ that the inner surface 25*c* is formed, taking the horizontal in FIG. 12B to be the standard. Therefore, as shown in FIG. 12C the shaft 20*a* is pushed from the groove 32 (see arrow symbol G). At this time, the spring member 24 assists in withdrawing the shaft 20*a*.

Then the opening unit 22 opens as the state shown in FIG. 9.

In this way, in the photocopier 100 according to the present embodiment, the groove 32 is formed extending in a different direction to the direction of the trajectory S of the shaft 20*a* shown in FIG. 9. Also, the groove 32 is provided between and formed by a pair of wall surfaces 31*a* and 31*b* provided on the bearing guide 31. The groove 32 is formed in a direction towards a center shaft 21*a* of the opposing roller 21. However, the bearing member 23 can move within the inside space 25*a* of the bearing holder 25 so the shaft 20*a* can be inserted into the groove 32. Also, when rotating the opening unit 22 so that the opening unit 22 opens, the shaft 20*a* can be pushed out of the groove 32.

Also, in the present embodiment, there is no necessity to form the groove 32 along the trajectory S of the shaft 20*a* so it is possible to increase the degree of freedom in design.

Also, in the image forming device according to the present embodiment, the groove 32 is formed in a direction towards the center shaft 21*a* of the opposing roller 21. In other words, the groove 32 is formed in the direction of the line that joins the axis of the secondary transfer roller 20 and the axis of the opposing roller 21. Therefore, it is possible for the secondary transfer roller 20 to press stably against the opposing roller 21.

To increase the degree of freedom in design in this way, the groove 32 can be formed in the direction of the center shaft 21*a* of the opposing roller 21, provided the configuration of the image forming device is one in which, as in the present embodiment, vertical transport is carried out, and the opening unit 22 is provided for clearing jams.

Also, in the present embodiment, the bearing holder 25 is configured to cover the bearing member 23. Therefore it is possible to make it difficult for toner particles to enter the sliding portion of the bearing member 23.

Also, in the present embodiment, during maintenance such as when the secondary transfer roller is being changed, the bearing holder 25 may be removed. Furthermore, the bearing holder 25 can be removed by simply moving the joining portions 27 in the direction of the arrow symbols D shown in FIG. 8, so maintainability is good.

When the opening unit 22 according to the present embodiment is in the closed state, the secondary transfer roller 20 is pressed in the horizontal direction by the spring member 24. The direction that the spring member 24 presses the secondary transfer roller 20 is different from the direction of extension of the groove 32. However, the direction that the spring member 24 presses the secondary transfer roller 20 may be the same as the direction of extension of the groove 32. In this case, the secondary transfer roller 20 can press against the opposing roller 21 in a more stable manner.

Also, the photocopier 100 according to the present embodiment is configured so that the shaft 20*a* is pressed downwards by the spring member 24 while contacting the frame surface 1*c* on the main body 1 side, and is inserted into the groove 32. However, a configuration in which the shaft 20*a* contacts the frame surface 1*c* below the groove 32 as a result of the rotation of the opening unit 22 and is inserted into the groove 32 may also be used.

Also, the present embodiment was explained for a case in which a part having the secondary transfer roller was the opening unit 22. However, the present invention is not limited to this case. For example, the present invention may also be applied to a case in which the opening unit is a part in which the roller on the side wall 1*a* side of the fixing unit 9 is installed. Furthermore, the installation unit according to the present invention may also be applied to the case where a groove is formed in the direction towards the center shaft of a registration roller 33*b* (see FIG. 1) provided on the main body 1 side, and the shaft of the registration roller 33*a* can be inserted into the groove.

Also, the photocopier 100 according to the present embodiment has a structure provided with an intermediate transfer belt 7. However, the present embodiment may also be applied to a monochrome photocopier in which there is no intermediate transfer belt, and the photosensitive drum directly presses against a transfer roller. In this case, the first roller of the present invention corresponds to the transfer roller, and the second roller of the present invention corresponds to the photosensitive drum.

Also, the present embodiment was explained using a photocopier as an example of an image forming device according to the present invention, however, a printer or facsimile machine may also be used.

INDUSTRIAL APPLICABILITY

The image forming device according to the present invention has the effect that the degree of freedom in design is increased compared with a conventional image forming device, and can be used for image forming devices such as printers, facsimiles, and so on.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of an image forming device of the present invention. Accordingly, these terms, as utilized to describe the present invention should be interpreted relative to an image forming device. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming device, comprising:

an image forming unit being configured to form images based on image information;

a main body being arranged to house said image forming unit, said main body having a transport path to transport sheets to form images by said image forming unit, said main body having a bearing guide disposed on said main body, said bearing guide having a groove;

an opening unit being configured to open and close relative to said main body, said opening unit being configured to expose said transport path when in an open position and to conceal said transport path when in a closed position;

a first roller having a shaft and being installed on said opening unit;

an installation unit being configured to install said first roller in said opening unit, said installation unit being configured to facilitate insertion of said shaft into said groove and movement of said first roller within a predetermined space within said installation unit; and a second roller being provided in said main body, said second roller being configured to press against said first roller in said closed position of said opening unit, said groove being arranged to extend in a direction different from a direction of the trajectory on which said shaft of said first roller moves when moving said opening unit prior to making and after breaking contact with said main body, and when closing said opening unit said shaft of said first roller being inserted into said groove while moving within said predetermined space.

2. The image forming device according to claim 1, wherein when said shaft of said first roller moves within said predetermined space, said shaft of said first roller moves while contacting a frame surface of said main body that connects to said groove.

3. The image forming device according to claim 1, wherein said installation unit has an elastic member that presses said first roller against said second roller, and said shaft of said first roller moves within said predetermined space while all or a part of the force taken when said opening unit is being closed is absorbed by said elastic member.

4. The image forming device according to claim 3, wherein said installation unit has a bearing member into which said shaft of said first roller is installed and a bearing holder that holds said bearing member and that is fixed to a frame surface of said opening unit to cover said bearing member, said elastic member is provided between said bearing member and said surface of said opening unit, and said predetermined space is provided between said bearing member and said elastic member.

5. The image forming device according to claim 4, wherein said groove is provided between a pair of wall surfaces disposed to encompass said trajectory of said shaft of said first roller in said groove, said bearing holder has a sloping surface formed on an end on said main body side, and when opening said opening unit from said closed position, said first roller is pushed from said groove by at least one of said wall surfaces forming said groove and said sloping surface formed in said end on said main body side of said bearing holder.

6. The image forming device according to claim 5, wherein when closing said opening unit from said open position, said first roller is inserted into said groove by sliding contact between said frame of said main body and said bearing holder and said shaft of said first roller.

7. The image forming device according to claim 6, wherein said bearing holder has a holding frame formed to cover said shaft of said first roller, and two joining portions disposed at both ends of said holding frame in a direction extending from a surface of said opening unit.

8. The image forming device according to claim 4, wherein when closing said opening unit from said open position, said first roller is inserted into said groove by sliding contact between said frame of said main body and said bearing holder and said shaft of said first roller.

9. The image forming device according to claim 1, further comprising an intermediate transfer belt, wherein said first roller is a secondary transfer roller, said second roller is an opposing roller in opposition to said secondary transfer roller, said intermediate transfer belt is provided between said secondary transfer roller and said opposing roller and wound around said opposing roller, and said opposing roller is pressed by said secondary transfer roller via said intermediate transfer belt.

10. The image forming device according to claim 1, wherein said first roller is a transfer roller, said second roller is a photosensitive drum, and said photosensitive drum is pressed by said transfer roller.

* * * * *